United States Patent [19]

Beyer

[11] 4,286,646

[45] Sep. 1, 1981

[54] METHOD FOR INOCULATING OR REFINING METAL MELTS

[75] Inventor: Horst Beyer, Burscheid, Fed. Rep. of Germany

[73] Assignee: Goetze AG, Burscheid, Fed. Rep. of Germany

[21] Appl. No.: 13,288

[22] Filed: Feb. 21, 1979

[30] Foreign Application Priority Data

Feb. 22, 1978 [DE] Fed. Rep. of Germany ..... 2807527

[51] Int. Cl.[3] ..... B22D 27/00

[52] U.S. Cl. ..... 164/57.1

[58] Field of Search ..... 164/55, 57, 56; 75/130 B, 130 BB, 45, 93 R

[56] References Cited

U.S. PATENT DOCUMENTS

| | | | |
|---|---|---|---|
| 963,973 | 7/1910 | Wright | 164/57 |
| 1,074,249 | 9/1913 | Connell | 164/57 |
| 2,869,857 | 1/1959 | Kopke et al. | 75/130 B |
| 3,514,285 | 5/1970 | Bakkerus | 75/93 X |

FOREIGN PATENT DOCUMENTS

| | | | |
|---|---|---|---|
| 1092496 | 5/1961 | Fed. Rep. of Germany . | |
| 2453254 | 7/1975 | Fed. Rep. of Germany . | |
| 1582624 | 10/1969 | France | 164/57 |
| 47-16332 | 1/1972 | Japan | 164/57 |
| 49-6721 | 2/1974 | Japan | 164/57 |
| 594177 | 2/1978 | U.S.S.R. | 75/130 B |

*Primary Examiner*—R. L. Spruill
*Assistant Examiner*—Gus T. Hampilos
*Attorney, Agent, or Firm*—Spencer & Kaye

[57] ABSTRACT

In order to inoculate or refine a metal by introducing an additive into a melt of the metal under high kinetic energy, the additive is placed in molten form for introduction into the melt.

4 Claims, 1 Drawing Figure

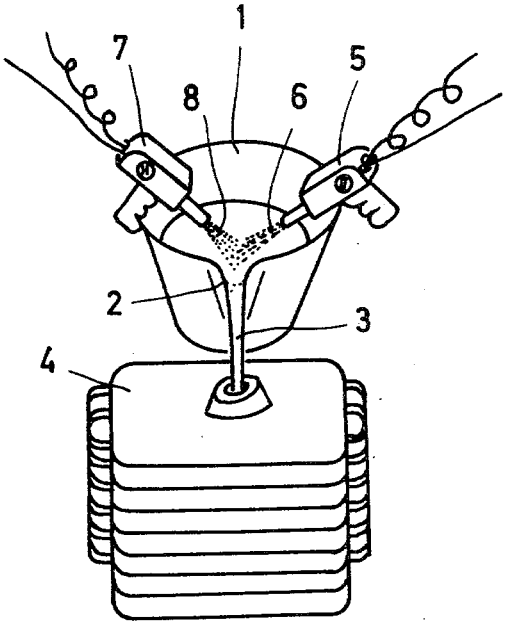
1
7
5
8
6
2
3
4

METHOD FOR INOCULATING OR REFINING METAL MELTS

BACKGROUND OF THE INVENTION

The present invention relates to a method for inoculating or refining metal melts by the addition of additives which are introduced into the metal melts by means of high kinetic energy.

In order to positively produce certain characteristics in metals or metal alloys, appropriate additives, elements or alloys are added to such melts, preferably directly preceding casting. For example, cast iron melts are treated with magnesium and/or inoculants to produce spherical graphite or certain structural characteristics, respectively. Aluminum-silicon alloys are refined by the addition of sodium, and steel melts are deoxidized or desulfured by means of additives.

According to presently practiced methods, the substances to be introduced for this purpose are usually added to the melts in pulverized or granular form in the furnace, in the casting pan or in the casting stream, preferably immediately preceding the actual casting. In this connection it is important that these additives are received in the correct quantities, as uniformly distributed as possible, and with low losses so as to avoid wasting the usually expensive additives by the use of excess quantities, melting losses, evaporation losses or floating. At the same time the presence of an air atmosphere may be a drawback in certain cases.

The problems encountered in the production of castings containing spheres of one component, such as graphite, during treatment with the very volatile and oxidizable magnesium are known in practice. For that reason, magnesium is presently added to cast iron melts usually in pressurized pans or special converters. The special equipment required for this purpose, however, involve new investment costs, and a long and costly time period expires between treatment and casting. If, on the other hand, elemental magnesium or pre-alloyed magnesium are added directly to the melts in solid form, there exists the danger, in addition to melting and evaporation losses, that the magnesium, on the one hand, if added in a finely pulverized form, is not sufficiently bound by the melt, while, on the other hand, if it is added in coarser grains, the magnesium may be unable to completely mix with the melt in the time remaining before solidification so that undesirable increases in concentration develop while other parts remain untreated. At the same time, the initially inflowing cast iron still comes into contact with cold magnesium which will not completely dissolve and thus the cast iron flows essentially untreated into the mold where it then solidifies. In particular, small cast pieces weighing up to one kilogram will then no longer have the required characteristics. The above-described drawback in the production of such castings applies in principle more or less also for the inoculation or refinement of cast iron or other metal melts depending on the physical and chemical properties of the additives, regardless of whether the treatment takes place in the furnace, in the pan, or in the casting stream by introduction of the substances in rod or powder form.

It has been proposed, for example, according to German Pat. No. 1,092,496 to overcome the above-described problems by adding magnesium or magnesium alloys, respectively, possibly together with the conventional inoculants in solid form by means of, for example, a blow tube and with the use of a carrier gas and to blow it onto the bath surface of cast iron melts. Although in this case, the additives, due to their increased kinetic energy, will be propelled to below the bath surface and a possibly inert carrier gas prevents melting losses, the proposal of the German patent requires that the additives melt and optimum mixing occurs only as a result of stirring the treated cast iron melt in pressure chambers or pressure pans. This process, in particular, requires additional equipment and the treatment connot be effected, as required for optimum effect, immediately before casting into the mold.

SUMMARY OF THE INVENTION

It is therefore an object of the present invention to provide a method according to which additives for metal melts, particularly for cast iron melts, can be introduced in as uniform a distribution as possible in precisely measured quantities, so that cast pieces of any desired size with uniform material properties can be cast with practically no losses due to melting or reaction with the ambient atmosphere, independently of the casting speed, if required also in an automatic casting system.

These and other objects are accomplished according to the present invention by introducing the additives into the metal melts in a molten liquid state with high kinetic energy. The injection of the molten additives can be effected, for example, by blowing in with the use of carrier gases. Preferably, spray pistols known from the thermal metal spraying art can be used for the blowing process in which the additives, which heretofore were supplied in powdered or rod form, are melted and then injected into the melt without problems in a manner that can be regulated down to the finest droplet form. Particularly for high melting point inoculants, such as carbides for example, plasma spray pistols can be used. At the same time the supply to the spray pistols can be regulated without difficulty so that precise quantities can be metered out as required.

In one embodiment of the present invention the metal melts are treated in the casting stream by spraying. The spraying in the casting stream may be effected continuously or intermittently according to the casting stream parameters, possibly also in a fully automatically controlled manner.

Various additives, for example ferrosilicon used as inoculant and magnesium to produce spherical graphite, can either be sprayed in mixture from a single spray pistol or by means of a combination of a plurality of feeding devices, simultaneously or in succession. If required, a single additive can be added from various feeding devices disposed at various different points so that even better mixing is realized.

The carrier gases must be inert with respect to the additives and their selection may be effected in such a manner that they additionally have a refining influence on the metal melts when they solidify.

By supplying the additives in a molten state as provided by the present invention they now dissolve immediately after injection into the metal melt in uniform dispersion. Increases in concentration and undissolved particles which remain solid for a longer period of time and which, in the prior art processes, float on the top, evaporate or form slag, do not occur so that the method according to the present invention can also be used to produce without problems cast pieces having a lower weight and essentially uniform structure characteristics without incurring losses from using excess quantities of the expensive additives. The addition of the molten additives according to the present invention can be effected in the melting furnace as well as in the casting pan or in the casting mold.

Preferably, the method according to the invention is carried out in a manner to introduce the additives into the casting stream immediately before it is poured into the mold, since particularly with the use of spray pistols the molten substances can be directed onto the outflowing metal in a focussed stream, where they then dissolve in the shortest possible time and are mixed in. At the same time, the quantity of the additive can be regulated automatically in proportion with the quantity of flowing metal so that the method according to the invention is particularly suitable for fully automatic casters.

BRIEF DESCRIPTION OF THE DRAWING

The sole FIGURE is a perspective pictorial view illustrating an arrangement for practicing the invention.

DESCRIPTION OF THE PREFERRED EMBODIMENTS

The drawing FIGURE is a schematic representation of a casting crucible 1, in suitable pouring position, and having a spout 2. Molten cast iron 3 flows in a stream through spout 2 and into a stacked sand mold 4 for the production of piston rings for internal-combustion engines. Magnesium is melted in an electric arc in the spray piston 5 and is blown, with the use of carbon dioxide as the carrier gas, in the form of a jet 6 onto the outflowing cast iron stream 3 in spout 2. In the spray pistol 7 ferrosilicon inoculant containing 25 percent by weight silicon is melted in an electric arc and is blown, with the use of carbon dioxide as carrier gas, in the form of a jet 8 onto the outflowing cast iron stream 3 in spout 2.

According to one example, a cast iron as usually employed for the production of piston rings is used which contains 3–4% carbon, 2–3% silicon, 0.2–0.5% manganese, up to 1.0% nickel as well as phophorus and sulfur in the usual quantities. Depending on the position and fill level of the crucible, the outflow speed of the iron during casting is 10 to 15 kg per second. Corresponding to the casting speed, 70–100 g molten magnesium per second are blown in a regulated manner under a pressure of 4 atmospheres gauge in a stream of carbon dioxide by means of the spray pistol 5. Further, by means of spray pistol 7, 50 to 75 g per second of molten ferrosilicon, consisting of 75% iron and 25% silicon are blown in a stream of carbon dioxide onto the outflowing cast iron in a regulated manner and in correspondence with the casting speed. The cast piston rings have a uniform structure of martensitic cast ion with embedded spherical graphite in uniform distribution.

It will be understood that the above description of the present invention is susceptible to various modifications, changes and adaptations, and the same are intended to be comprehended within the meaning and range of equivalents of the appended claims.

What is claimed is:

1. In a method for inoculating or refining a metal by introducing an additive into a melt of the metal under high kinetic energy and wherein the melt is poured in the form of a stream from a crucible via a casting spout thereof, the improvement wherein said step of introducing is carried out with a magnesium or a magnesium alloy additive in molten form by blowing the molten additive into the melt stream with a carrier gas while the melt is being poured, at the location of the casting spout, by forming a spray of the molten additive with the carrier gas, which spray is laterally unrestricted, to dissolve the additive immediately into the metal melt in uniform dispersion, said melt being poured from the crucible into a stacked sand casting mold to produce piston rings and the composition of the melt being such as to produce cast iron piston rings containing spheres of graphite.

2. A method as defined in claim 1 comprising regulating the rate of introduction of the additive in proportion to the rate at which melt is being poured.

3. A method as defined in claim 1 wherein said step of introducing is carried out to introduce a plurality of additives by means of a corresponding plurality of feeding devices.

4. A method as defined in claim 1 wherein said step of introducing is carried out by melting the additive by means of a spray pistol and blowing the molten additive into the melt by means of a carrier gas.

* * * * *